US010724376B2

(12) United States Patent
Kray et al.

(10) Patent No.: US 10,724,376 B2
(45) Date of Patent: Jul. 28, 2020

(54) AIRFOIL HAVING INTEGRAL FINS

(71) Applicant: GENERAL ELECTRIC COMPANY, Schenectady, NY (US)

(72) Inventors: Nicholas Joseph Kray, Mason, AZ (US); Nitesh Jain, Bangalore (IN); Nagashiresha Gontla, Bangalore (IN); Narendra Digamber Joshi, Schenectady, NY (US); Paul Gerard Marsland, Milford, OH (US); Wayne Allen Spence, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 77 days.

(21) Appl. No.: 15/891,401

(22) Filed: Feb. 8, 2018

(65) Prior Publication Data

US 2020/0149399 A1 May 14, 2020

(51) Int. Cl.
*F01D 5/12* (2006.01)
*F01D 5/30* (2006.01)

(52) U.S. Cl.
CPC ..... *F01D 5/12* (2013.01); *F01D 5/30* (2013.01); *F05D 2220/30* (2013.01)

(58) Field of Classification Search
CPC ..... F01D 5/16; F01D 5/18; F01D 5/26; F01D 25/04; F01D 25/06; F04D 29/324; F04D 29/668; F05D 2230/232; F05D 2300/133; Y10S 416/50
See application file for complete search history.

(56) References Cited

U.S. PATENT DOCUMENTS 2,689,107 A * 9/1954 Odegaard ..... F01D 5/16 416/233
2,828,941 A * 4/1958 Foley ..... F01D 5/16 416/231 R
2,906,495 A * 9/1959 Schum ..... F01D 5/188 416/92
2,977,089 A * 3/1961 McCarty ..... F01D 5/18 416/96 R
3,027,138 A * 3/1962 Howell ..... F01D 5/16 416/220 R
3,954,230 A 5/1976 Machuta
3,966,357 A 6/1976 Corsmeier
4,188,171 A 2/1980 Baskin
5,165,860 A * 11/1992 Stoner ..... F01D 5/26 416/224
6,039,542 A 3/2000 Schilling et al.
6,102,664 A 8/2000 Nguyen
6,155,789 A 12/2000 Mannava et al.
6,224,341 B1 5/2001 Fricke
6,283,707 B1 9/2001 Chin
7,300,256 B2 * 11/2007 Masserey ..... F01D 5/16 416/230

(Continued)

FOREIGN PATENT DOCUMENTS

GB 2071775 A 9/1981

*Primary Examiner* — Igor Kershteyn
(74) *Attorney, Agent, or Firm* — Hanley, Flight & Zimmerman, LLC

(57) ABSTRACT

A blade and a turbomachine engine having the blade are disclosed. The blade includes an airfoil having a root portion, a tip portion, and a plurality of fins integrally coupled to the root portion. The plurality of fins is disposed along a thickness of the airfoil.

20 Claims, 9 Drawing Sheets

(56) References Cited

U.S. PATENT DOCUMENTS

| | | | | |
|---|---|---|---|---|
| 7,329,102 | B2 * | 2/2008 | McMillan | F01D 5/147 416/229 A |
| 7,824,158 | B2 | 11/2010 | Bauer et al. | |
| 7,955,054 | B2 | 6/2011 | El-Aini et al. | |
| 8,267,662 | B2 | 9/2012 | Patrick et al. | |
| 9,488,066 | B2 * | 11/2016 | Yamashita | F01D 5/16 |
| 2005/0047918 | A1 * | 3/2005 | Powell | F01D 5/16 416/233 |
| 2016/0341221 | A1 | 11/2016 | Twelves, Jr. et al. | |

* cited by examiner

AIRFOIL HAVING INTEGRAL FINS

FIELD OF INVENTION

Embodiments of the present invention relate generally to airfoil of gas turbine engines and more particularly to an airfoil of a blade having a plurality of internal fins.

BACKGROUND

Gas turbine engines for aircraft, marine, and land use typically have axial flow turbines that comprise a number of rotatable discs, each of which carries an annular array of radially extending airfoils of the blades on its periphery. Each blade airfoil is provided with a root portion by means of which it is attached to its associated disc. While such a method of attachment is effective in ensuring the integrity of each blade/disc assembly, problems can still arise because of airfoil vibration. Such vibration, if unchecked, may lead to reduction in blade life, and in some cases rapid damage to the blades.

The airfoils are generally designed to have high tolerances to accommodate significant operational requirements such as crosswinds. However, the airfoils may be prone to high vibratory responses and possible aero elastic instability within some operational speed ranges that may result in flutter. Airfoil flutter is a result of complex interactions between fluid flow, stiffness, and inertial forces on an airfoil.

To resist flutter, the airfoils are designed to have sufficient torsional stiffness, bending stiffness, and structural damping. However, some structural damping may also result in an addition of weight to the airfoil. Therefore, it is desirable to have a damper to the airfoil that would effectively address torsional vibration without increasing the airfoil weight.

BRIEF DESCRIPTION

In one aspect, a blade is disclosed. The blade includes an airfoil having a root portion, a tip portion, and a plurality of fins integrally coupled to the root portion. The plurality of fins is disposed along a thickness of the airfoil.

In another aspect, a blade is disclosed. The blade includes an airfoil having a root portion, a tip portion, and a plurality of fins integrally coupled to the root portion. The plurality of fins is disposed along a thickness of the airfoil within an internal cavity. The internal cavity has a volume less than 20% of the volume of the airfoil.

In yet another aspect, a turbomachine engine having a blade are disclosed. The blade includes an airfoil having a root portion, a tip portion, and a plurality of fins integrally coupled to the root portion. The plurality of fins is disposed along a thickness of the airfoil.

DRAWINGS

These and other features and aspects of embodiments of the disclosed technique will become better understood when the following detailed description is read with reference to the accompanying drawings in which like characters represent like parts throughout the drawings.

DETAILED DESCRIPTION

In the following specification and the claims, which follow, reference will be made to a number of terms, which shall be defined to have the following meanings. The singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

The blade described herein provides a means to dampen an airfoil using integrally built, plurality of fins that functions as an integral damper. The plurality of fins is located inside the airfoil and is free to vibrate. Such vibrational movements may generate friction in between the fins of the plurality or between the fins and internal surfaces of the airfoil. This friction of fins may dissipate vibrations and thereby dampen the pressures exerted on the airfoil. Since the plurality of fins are built integrally, a root thickness of the airfoil can be reduced, thereby resulting in increase in airfoil performance without increasing the airfoil thickness.

Figure 1:
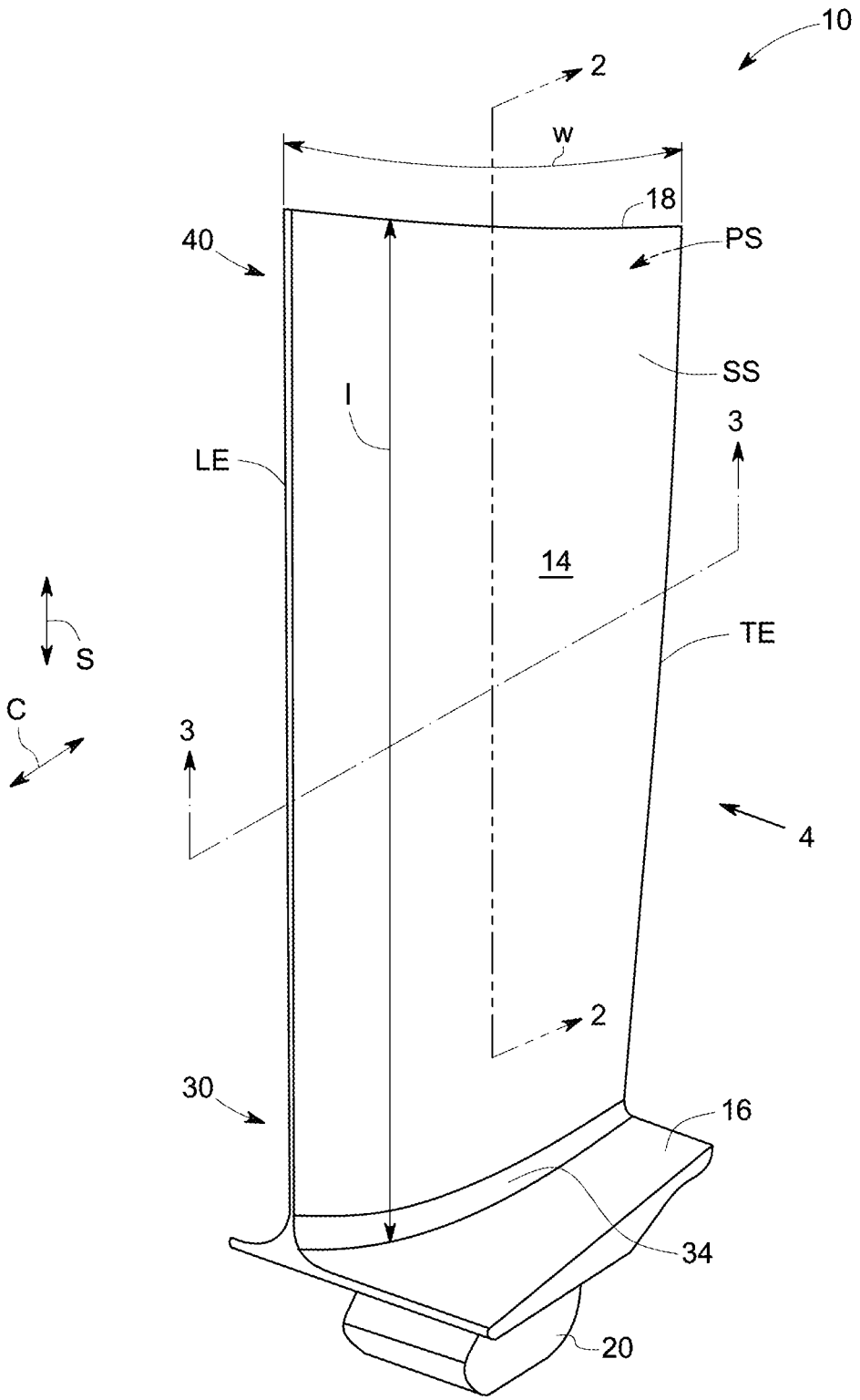
FIG. 1 is a perspective view illustration of a gas turbine engine blade having an airfoil, in accordance with some embodiments of the disclosure.

Illustrated in FIG. 1 is a gas turbine engine blade 10, such as a fan or compressor blade. The blade 10 includes an airfoil 14 extending radially outward, in a span wise direction S, from a blade platform 16 to a blade tip 18. The fan blade 10 includes a root section 20 extending radially inward from the platform 16. In some embodiments, the root section 20 defines an attachment such as an inverted "fir tree"-like shape, bulb, or dovetail so the airfoil 14 is slidably received in a complimentary configured recess provided in the root section 20.

The airfoil 14 extends from a root portion 30 to a tip portion 40. The root portion 30 of the airfoil 14 includes the root 34 of the airfoil and the tip portion 40 of the airfoil 14 includes the tip 18 of the airfoil, which is also the tip of the blade 10. The airfoil 14 extends in a chord-wise direction C between a leading edge (LE) and a trailing edge (TE) of the airfoil 14. The airfoil 14 has a pressure side PS and a suction side SS. A thickness of the airfoil 14 at any given point along length l defined in the span wise direction S and any given point along width w in the chord-wise direction C is defined as the shortest distance between the pressure side PS and the suction side SS at that point. The width w and thickness may vary in the span wise direction S.

Figure 2:
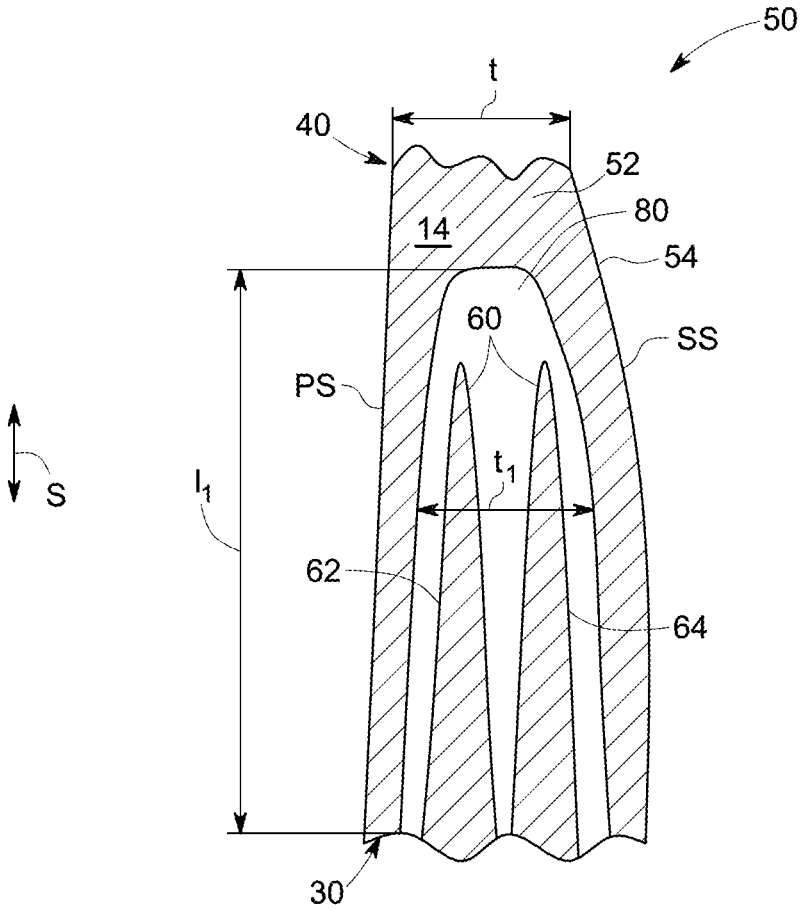
FIG. 2 illustrates a cross-section of an airfoil in the 2-2 direction as shown in FIG. 1, in accordance with some embodiments of the disclosure.

FIG. 2 illustrates a cross-section 50 of the airfoil 14 taken in the 2-2 direction shown in FIG. 1, typically showing the cross-section along the thickness t of the airfoil 14. The cross-section 50 shows a plurality of fins 60 along the thickness t of the airfoil 14. In certain embodiments, the plurality of fins 60 includes only two fins in the thickness direction. In some embodiments, the number of fins in the thickness direction is three. In specific embodiments, the plurality of fins may include more than three fins. In some embodiments, four or more fins are disposed in the thickness direction of the airfoil 14. In an example embodiment, the plurality of fins 60 includes one fin 62 near to the pressure side PS of the airfoil 14 and another fin 64 near to the suction side SS, as shown in FIG. 2. Even though the fins 62 and 64 are shown as tongue structures and as parallel to each other in the example embodiments shown throughout this disclosure, the fins may have different structures and may have any mutual placements for damping the airfoil 14. Further, each fin of the plurality of fins 60 may or may not be of the same shape, structure, material composition, or combinations thereof.

In some embodiments, the plurality of fins 60 is located in an internal portion 52 of the airfoil 14. The internal portion 52 of the airfoil 14 is a portion that is bounded by an external surface 54 that is exposed to the ambient in which the airfoil 14 is operating. The plurality of fins 60 functions as an internal damper of the airfoil 14 and aids in internal damping of the airfoil 14. When the blade 10 is subjected to pressure and vibrations, the fins may vibrate and rub against each other or against the internal surface of the airfoil, thereby damping the vibrations.

The plurality of fins 60 is integrally coupled to the root portion 30 of the airfoil 14. As used herein, the term "integrally coupled" refers to a monolithic form of the structure of the airfoil having the plurality of fins. Thus, the plurality of fins 60 in the airfoil 14 is a continuous structure of the airfoil and the connection between the plurality of fins and the rest of the airfoil 14 structure is free of any joints. In some embodiments, the integrally coupled plurality of fins is formed during the formation of the airfoil as one structure during processing, without any brazing or multiple sintering steps. In some embodiments the airfoil, including the plurality of fins, is made using a single material. In some embodiments, the airfoil 14 having the integrally coupled plurality of fins is fabricated using an additive manufacturing technique.

"Additive manufacturing" is a term used herein to describe a process which involves layer-by-layer construction or additive fabrication (as opposed to material removal as with conventional machining processes). Such processes may also be referred to as "rapid manufacturing processes". The additive manufacturing process forms net or near-net shape structures through sequentially and repeatedly depositing and joining material layers. As used herein the term "near-net shape" means that the additively manufactured structure is formed very close to the final shape of the structure, not requiring significant traditional mechanical finishing techniques, such as machining or grinding following the additive manufacturing process. Additive manufacturing systems and methods include, for example, and without limitation, vat photopolymerization, powder bed fusion, binderj etting, material jetting, sheet lamination, material extrusion, directed energy deposition and hybrid systems. These systems and methods may include, for example, and without limitation, stereolithography; digital light processing; scan, spin, and selectively photocure; continuous liquid interface production; selective laser sintering; direct metal laser sintering; selective laser melting; electron beam melting; selective heat sintering; multi-jet fusion; smooth curvatures printing; multi-jet modeling; laminated object manufacture; selective deposition lamination; ultrasonic additive manufacturing; fused filament fabrication; fused deposition modeling; laser metal deposition; laser engineered net shaping; direct metal deposition; hybrid systems; and combinations of these methods and systems. These methods and systems may employ, for example, and without limitation, all forms of electromagnetic radiation, heating, sintering, melting, curing, binding, consolidating, pressing, embedding, and combinations thereof. In some embodiments, additive manufacturing may be used to manufacture articles using computer aided design (CAD) models.

Figure 3:
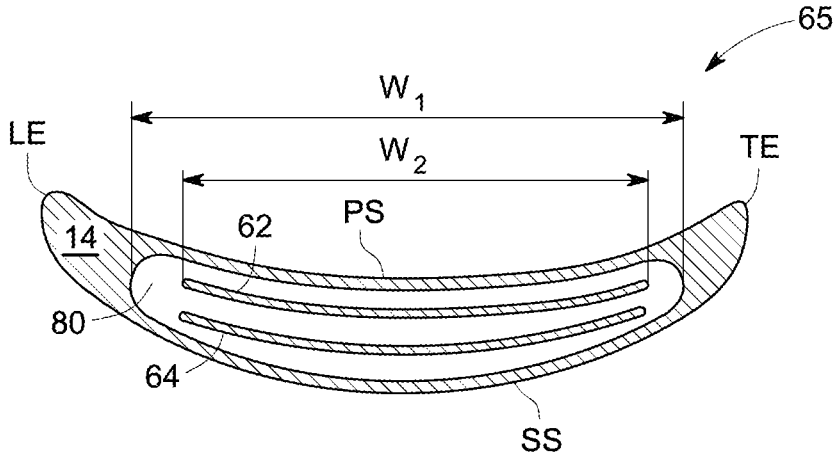
FIG. 3 illustrates a cross-section of an airfoil in the 3-3 direction as shown in FIG. 1, in accordance with some embodiments of the disclosure.
Figure 4:
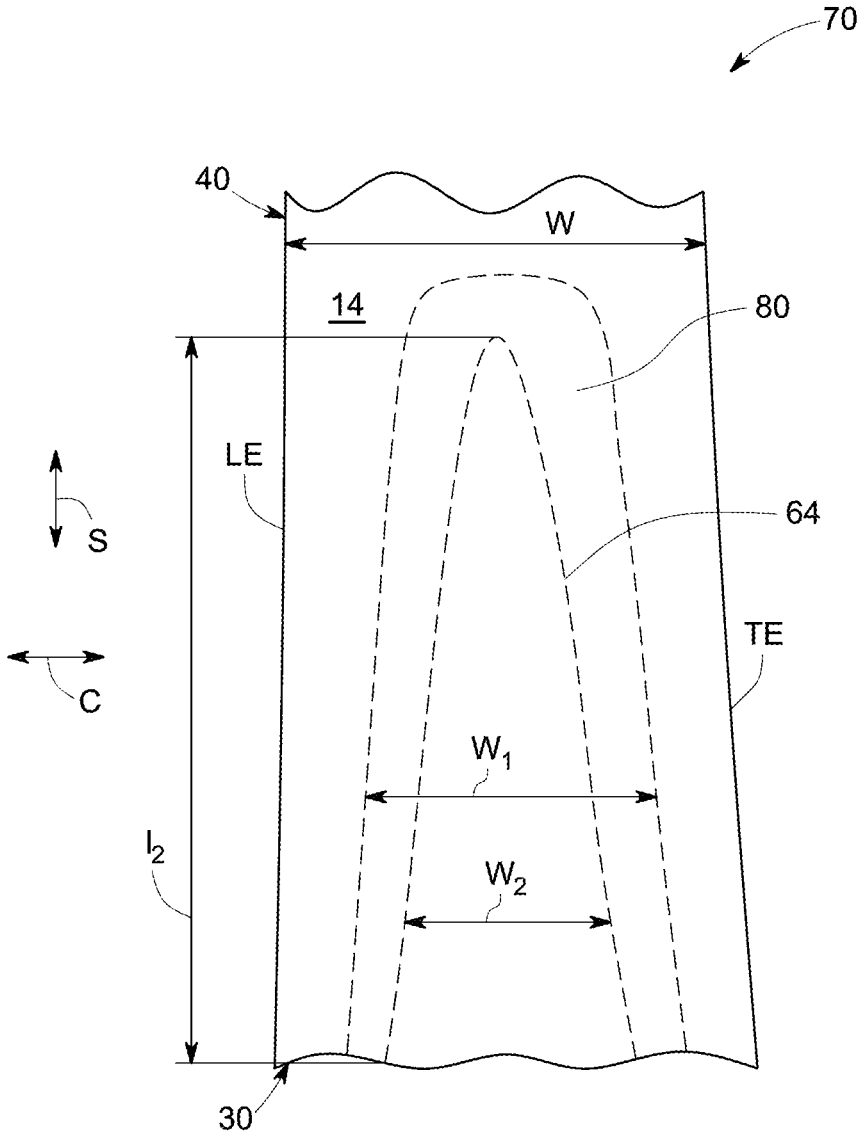
FIG. 4 illustrates a schematic view of an airfoil in a chord-wise direction of an airfoil, in accordance with some embodiments of the disclosure.

FIG. 3 illustrates a cross-section 65 of the airfoil 14 taken in the 3-3 direction shown in FIG. 1. FIG. 4 illustrates a schematic view 70 of the airfoil 14 along the chord-wise direction C, when viewed from the direction 4 denoted in FIG. 1. In some embodiments, the airfoil 14 includes at least one internal cavity 80, as shown in FIGS. 2-4. In some embodiments, the plurality of fins 60 is disposed within the at least one internal cavity 80 of the airfoil 14, as shown in FIG. 2. The at least one internal cavity 80 may be of any shape and size, thereby aiding the damping function of the plurality of fins 60.

In some embodiments, the airfoil 14 has a solid structure except for the presence of the at least one internal cavity 80. Therefore, in some embodiments, more than 50 volume % of the airfoil 14 is a solid structure and 50 volume % or less of the airfoil 14 has the cavity. In some embodiments, a volume of the at least one internal cavity 80 is less than 40% of the volume of the airfoil 14. In some embodiments, a volume of the at least one internal cavity 80 is less than 20% of the volume of the airfoil 14.

Figure 6:
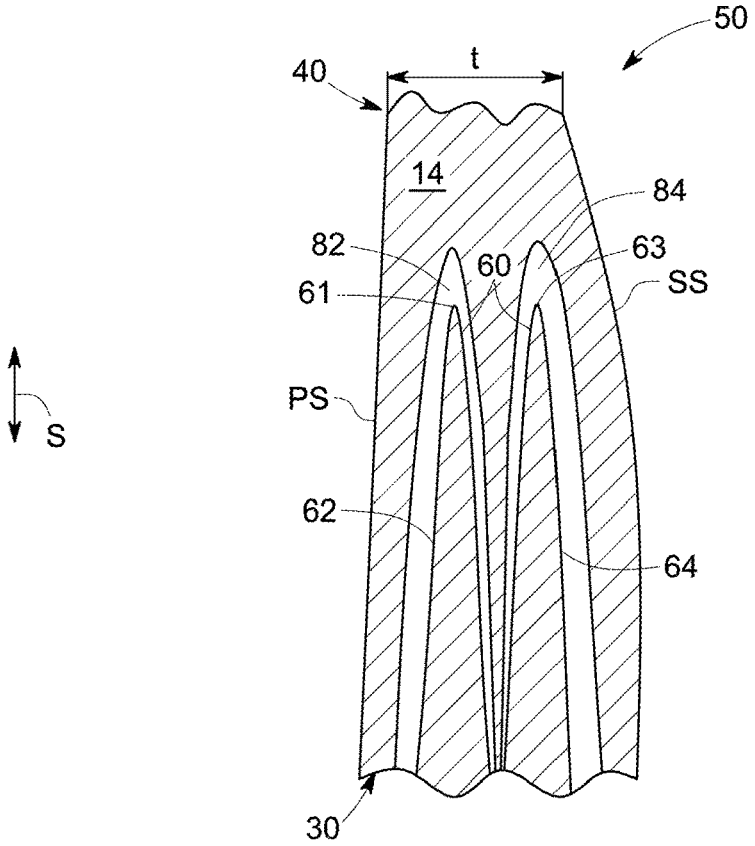
FIG. 6 illustrates a cross-section of an airfoil in the 2-2 direction as shown in FIG. 1, in accordance with some embodiments of the disclosure.
Figure 7:
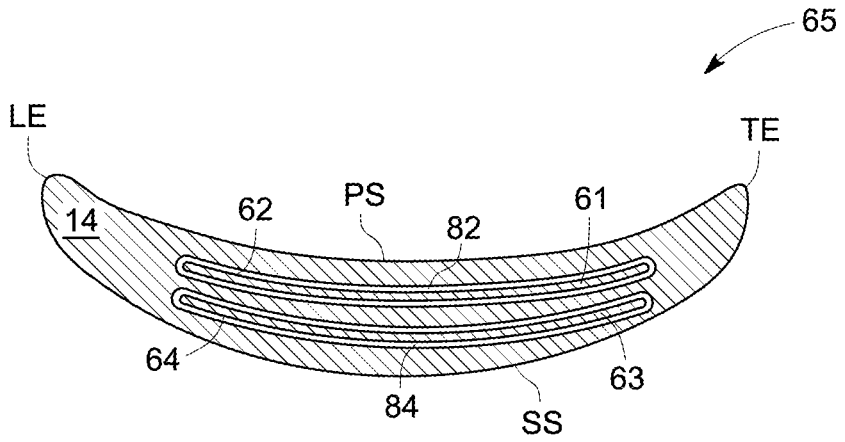
FIG. 7 illustrates a cross-section of an airfoil in the 3-3 direction as shown in FIG. 1, in accordance with some embodiments of the disclosure.

In some embodiments, the internal cavity 80 is a single cavity, as illustrated in FIGS. 2 and 4. In some embodiments, the at least one internal cavity 80 has a length $l_1$ along a span wise direction S of the airfoil 14 as shown in FIG. 2, a width $w_1$ along a chord-wise direction C of the airfoil 14, as shown in FIG. 3, and a thickness $t_1$ along the thickness t of the airfoil 14, as shown in FIG. 2. In some embodiments, the at least one internal cavity 80 may be a single cavity having a double-tip shape such that tips 61, 63 of the individual fins 62, 64 are separated by each other by the internal cavity 80, as illustrated, for example, in FIG. 5. There may be more than one internal cavities 80 in the airfoil 14. In some embodiments, the airfoil 14 includes a plurality of internal cavities and each fin of the plurality of fins 60 is disposed within each cavity of a plurality of internal cavities of the airfoil, as shown FIG. 6. FIG. 6 illustrates two fins 62 and 64 that are disposed individually inside two internal cavities 82 and 84 respectively. The cavities 82 and 84 are present along the thickness t of the airfoil 14. Thus, in some embodiments, each fin 62, 64 of the plurality of fins 60 is individually disposed within each cavity 82, 84 of a plurality of internal cavities of the airfoil 14. Thus, in some embodiments, fin 62 is disposed within the cavity 82 and the fin 64 is disposed within the cavity 84. In some other embodiments, there may be a plurality of internal cavities 82, 84 and each internal cavity 82, 84 may have plurality of fins 60 disposed within each of the internal cavities (not shown in figures). FIG. 7 illustrates a cross-section 65 of the airfoil 14 shown in FIG. 6, in a plane perpendicular to the span S of the airfoil 14. FIG. 7 illustrates a perpendicular view of each fin 62, 64 of the plurality of fins 60 disposed within each cavity 82, 84 of a plurality of internal cavities of the airfoil 14. In some embodiments, FIG. 7 may also represent tip portions of the fins 62, 64 in a single, double-tip cavity 80, as illustrated in FIG. 5.

In some embodiments, a length (i.e., span), width, thickness, or combinations thereof of the airfoil 14 at different portions of the airfoil 14 may vary. For example, a width w of the airfoil 14 at a portion in between the root portion 30 and the tip portion 40 may be different from the width w of the airfoil at any one of or both of the root portion 30 and the tip portion 40. In some embodiments, a thickness t of the airfoil 14 may vary in a span-wise direction S, in a chord-wise direction C, or a combination thereof. In some embodiments, a length $l_1$, width $w_1$, thickness $t_1$, or any combinations thereof of the at least one internal cavity 80 may vary. In some embodiments, the at least one internal cavity 80 has a varying width, varying thickness, or a combination thereof along the span of the airfoil 14.

Figure 5:
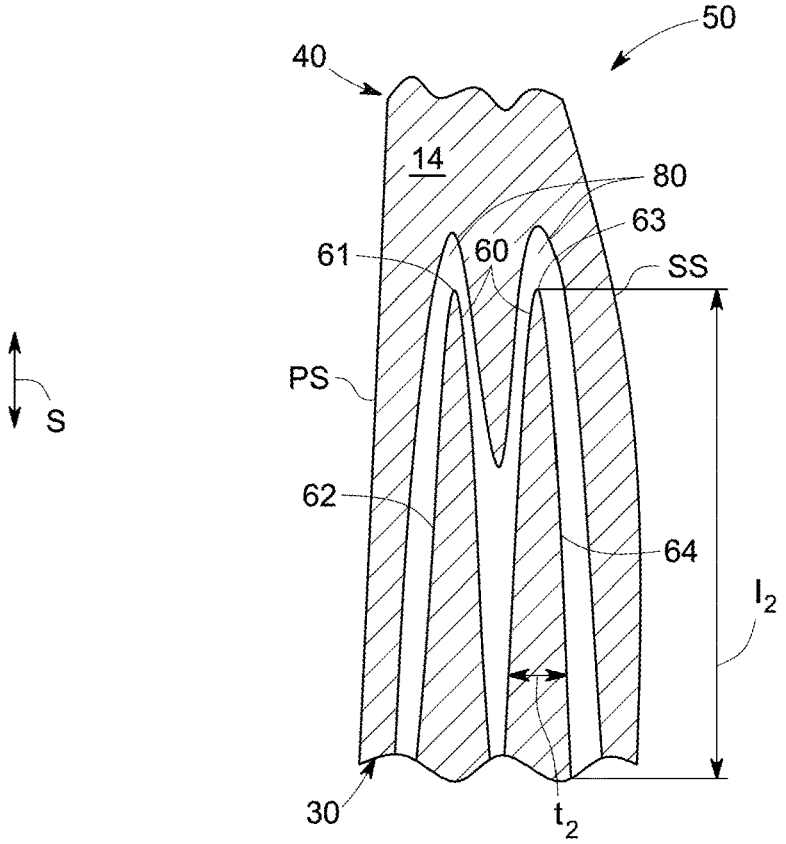
FIG. 5 illustrates a cross-section of an airfoil in the 2-2 direction as shown in FIG. 1, in accordance with some embodiments of the disclosure.

In some embodiments, at least one fin 64 of the plurality of fins 60 has a length $l_2$ along a span-wise direction S of the airfoil 14, a width $w_2$ along a chord-wise direction C of the airfoil 14, and a thickness $t_2$ along the thickness t of the airfoil 14, as shown in FIGS. 3-5. Length $l_2$, width $w_2$, thickness $t_2$, or any combinations thereof of the at least one fin 64 of the plurality of fins 60 may be same as, or different from, the length, width, thickness, or any combinations thereof respectively, of other fin or fins in the plurality of fins 60. In some embodiments, the length $l_2$ of the at least one fin 64 is in a range from about 30% to about 90% of the length l of the airfoil 14. In some embodiments, the width $w_2$ of the at least one fin 64 is in a range from about 30% to about 90% of the width (chord length) w of the airfoil 14. In some embodiments, the thickness $t_2$ of the at least one fin 64 is in a range from about 15% to about 30% of the thickness t of the airfoil 14. In some embodiments, a length $l_2$, width $w_2$, thickness $t_2$, or any combinations thereof of the at least one fin 62, 64 may vary. In some embodiments, the at least one fin 62, 64 has varying width $w_2$, varying thickness $t_2$, or a combination thereof along the span of the airfoil. In some embodiments, a distance between two adjacent fins 62 and 64 in the plurality of fins 60 is less than 30% of the thickness of the airfoil.

Figure 8:
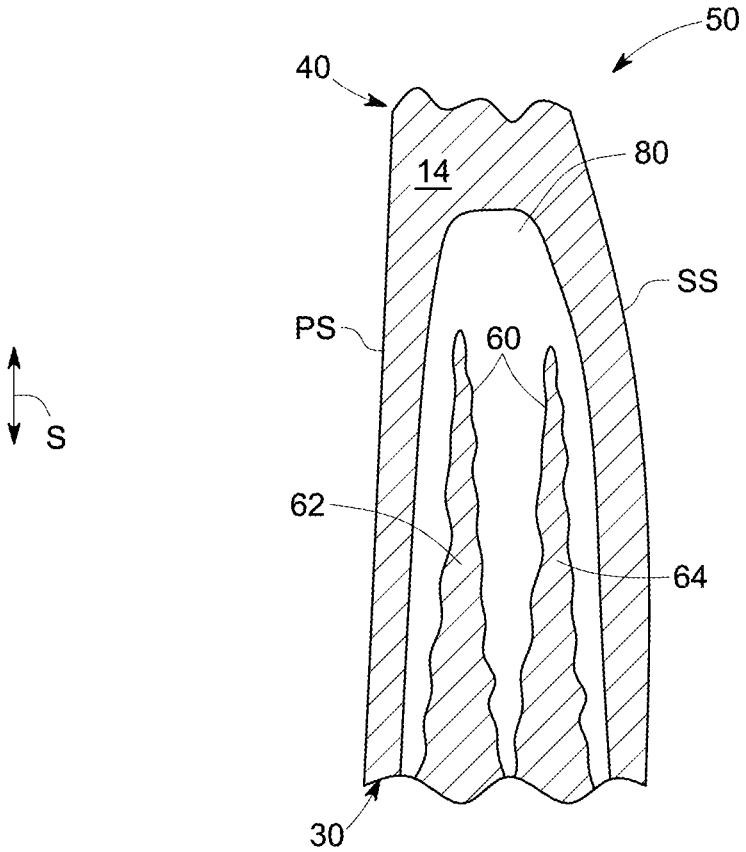
FIG. 8 illustrates a cross-section of an airfoil in the 2-2 direction shown in FIG. 1, in accordance with some embodiments of the disclosure.
Figure 9:
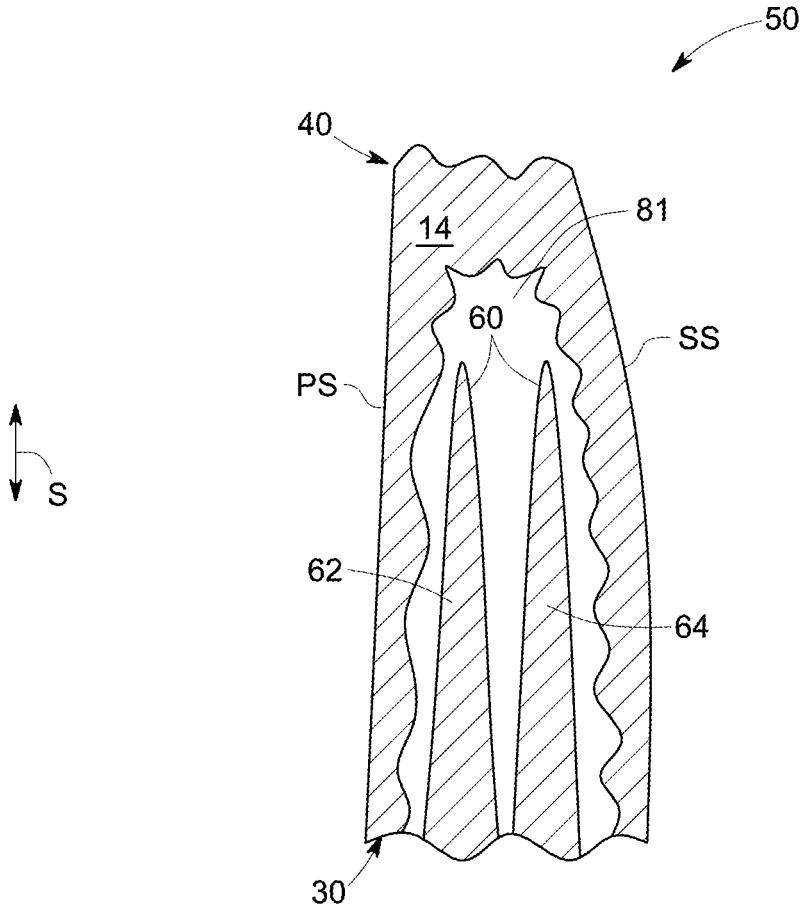
FIG. 9 illustrates a cross-section of an airfoil in the 2-2 direction as shown in FIG. 1, in accordance with some embodiments of the disclosure.
Figure 10:
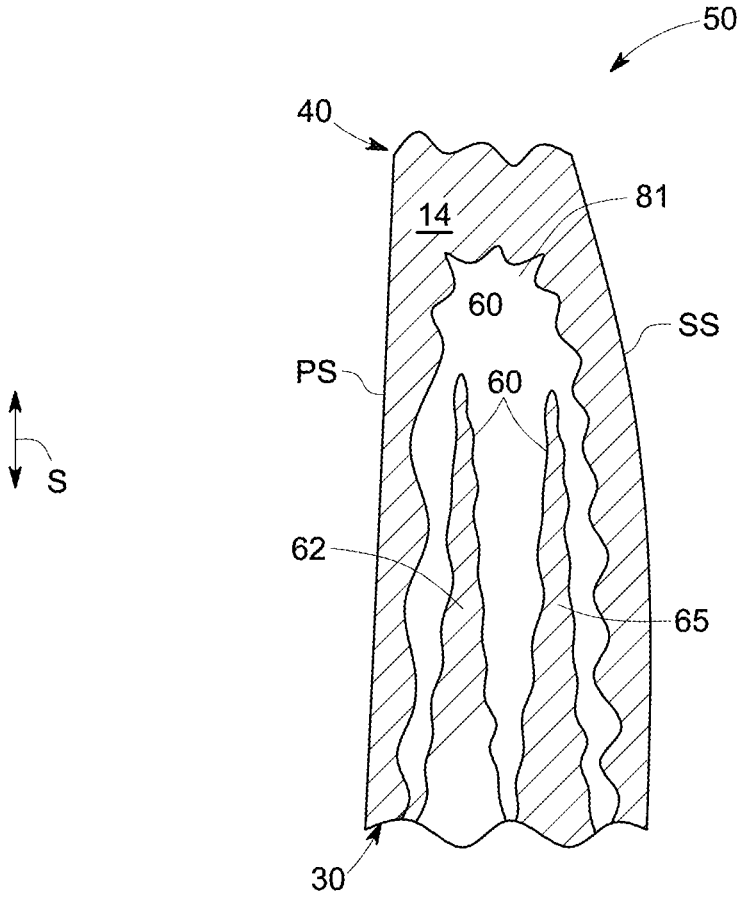
FIG. 10 illustrates a cross-section of an airfoil in the 2-2 direction as shown in FIG. 1, in accordance with some embodiments of the disclosure.

In some embodiments, the at least one fin 62, 64 of the plurality of fins 60 has a corrugated surface, as shown in FIG. 8. In some embodiments, the at least one internal cavity is an internal cavity 81 having a corrugated surface, as shown in FIG. 9. In certain embodiments, both the plurality of fins 60 and the at least one internal cavity 81 may have corrugated surfaces, as shown in FIG. 10, for example. The corrugated surface of the at least fin 62, 64, the at least one cavity 81, or a combination of both may aid in multiple point of friction between the fins 62, 64 of the plurality of fins, or between the plurality of fins and an internal surface of the airfoil 14, thereby aiding internal damping. In some embodiments, the blade 10 may be a part of a turbomachine engine.

Figure 11:
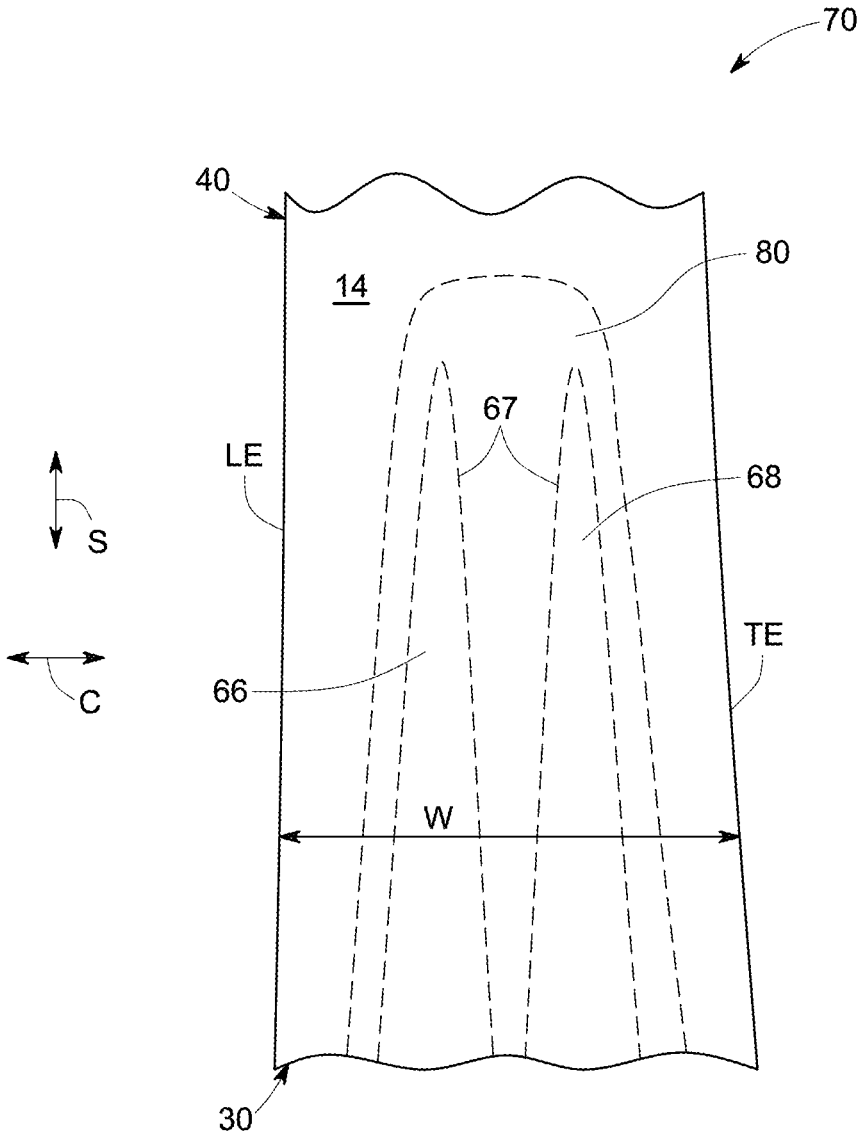
FIG. 11 illustrates a schematic view of an airfoil in a chord-wise direction of an airfoil, in accordance with some embodiments of the disclosure.

In some embodiments, in addition to having plurality of fins 60 disposed along the thickness t, the airfoil 14 may further have a plurality of fins 67 disposed along the chord-wise direction C of the airfoil, as schematically shown in FIG. 11. There may be any number of fins present in the plurality of fins 67. FIG. 11 specifically illustrates two fins 66 and 68 disposed in the chord-wise direction, in the width w of the airfoil 14. In some embodiments, any one of, or both of the fins 66 and 68 may be part of the plurality of fins 60 illustrated earlier in FIGS. 2-10. In some embodiments, the plurality of fins 67 may be disposed inside the same at least one cavity 80, 81, as illustrated in FIGS. 2-5 and 8-10. In some embodiments, the plurality of fins 67 disposed in the chord-wise direction may be surrounded by separate cavity or plurality of cavities (not specifically shown in figures). The length, width, thickness, shape, size etc. of the plurality of fins 67 may be similar or different from the plurality of fins 60, described earlier.

In some specific embodiments, a blade having an airfoil is discussed. The blade includes a root portion, a tip portion, and a plurality of fins integrally coupled to the root portion. The plurality of fins is disposed along a thickness of the airfoil within an internal cavity. The internal cavity has a volume less than 20% of the volume of the airfoil. In some embodiments, at least one fin of the plurality of fins has a length along a span of the airfoil, a width along a chord-wise direction of the airfoil, and a thickness along the thickness of the airfoil. In some embodiments, the length of the at least one fin is in a range from about 30% to about 90% of the span, the width is in a range from about 30% to about 90% of the chord length, and the thickness is in a range from about 15% to about 30% of the thickness of the airfoil.

Figure 12:
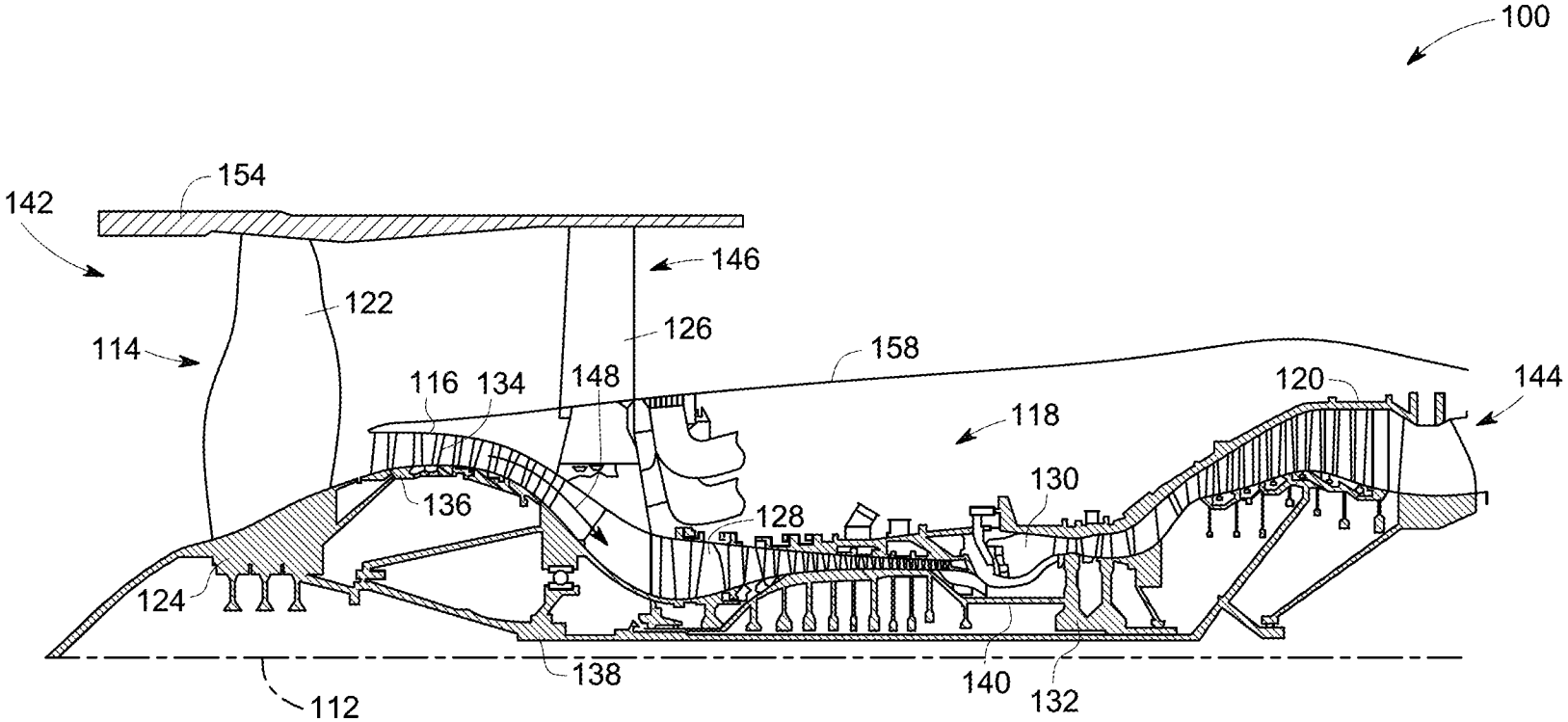
FIG. 12 illustrates a cross-sectional view of a turbomachine engine having a blade shown in FIG. 1, in accordance with some embodiments of the disclosure.

FIG. 12 illustrates a schematic cross-sectional view of a turbomachine engine 100 having a blade 10, in accordance with some embodiments of the present disclosure. In some embodiments, the turbomachine engine 100 may be a gas turbine engine of an aircraft. In some embodiments, the turbomachine engine 100 includes a centerline axis 112, a fan assembly 114, a booster compressor 116, a core engine 118, such as, a gas turbine engine, and a low-pressure turbine 120 that may be coupled to the fan assembly 114 and the booster compressor 116. The fan assembly 114 includes a rotor fan blade 122 that extends substantially radially outward from a fan rotor disk 124, an outlet guide vane 126 positioned downstream of the rotor fan blade 122, and a fan casing 154 encompassing the rotor fan blade 122 and the outlet guide vane 126. The core engine 118 includes a high-pressure compressor 128, a combustor 130, and a high-pressure turbine 132. The core engine 118 further includes an engine casing 158 encompassing the components of the engine. The outlet guide vane 126 is disposed between the engine casing 158 and the fan casing 154. The booster compressor 116 includes a plurality of rotor blades 134 that extend substantially radially outward from a compressor rotor disk 136 coupled to a first drive shaft 138. The high-pressure compressor 128 and the high-pressure turbine 132 are coupled together by a second drive shaft 140. The turbomachine engine 100 also includes an intake side 142, a core engine exhaust side 144, and a fan exhaust side 146.

During operation, the fan assembly 114 compresses air entering the turbomachine engine 100 through the intake side 142. The airstream exiting the fan assembly 114 is split such that a portion of the airflow 148 is channeled into the booster compressor 116, as compressed airstream, and a remaining portion of the airstream bypasses the booster compressor 116 and the core engine 118 and exits the turbomachine engine 100 through the fan exhaust side 146. The plurality of rotor blades 134 compresses and delivers the compressed airflow 148 towards the core engine 118. The airflow 148 is further compressed by the high-pressure compressor 128 and is delivered to the combustor 130. The compressed airflow 148 from the combustor 130 drives the rotating high-pressure turbine 132 and the low-pressure turbine 120 and exits the turbomachine engine 100 through the core engine exhaust side 144.

The blade 10 shown in FIG. 1 may be a fan blade 122 or the compressor blade 134 of the gas turbine engine. The blade 10 includes an airfoil that has a root portion, a tip portion, and a plurality of fins integrally coupled to the root portion. The plurality of fins is disposed along a thickness of the airfoil. In some embodiments, the plurality of fins is disposed within at least one internal cavity of the airfoil. In some embodiments, the at least one internal cavity has a length along a span of the airfoil, a width along a chord-wise direction of the airfoil, and a thickness along the thickness of the airfoil.

While only certain features of embodiments have been illustrated, and described herein, many modifications and changes will occur to those skilled in the art. It is, therefore, to be understood that the appended embodiments are intended to cover all such modifications and changes as falling within the spirit of the disclosed technique.

The invention claimed is:

1. A blade comprising:
an airfoil comprising:
a root portion;
a tip portion;
at least one internal cavity; and
a plurality of fins disposed in the at least one internal cavity and integrally coupled to the root portion,
wherein the plurality of fins are disposed along a thickness of the airfoil,
wherein tips of the plurality of fins are spaced apart from each other along the thickness of the airfoil, and
wherein the tips of the plurality of fins are spaced apart from walls of the at least one internal cavity along the thickness of the airfoil.

2. The blade of claim 1, wherein the at least one internal cavity has a length along a span of the airfoil, a width along a chord-wise direction of the airfoil, and a thickness along the thickness of the airfoil.

3. The blade of claim 2, wherein the at least one internal cavity has a varying width, varying thickness, or a combination thereof, along the span of the airfoil.

4. The blade of claim 1,
wherein the airfoil comprises a plurality of internal cavities including the at least one internal cavity, and
wherein each fin of the plurality of fins is disposed within each cavity of the plurality of internal cavities of the airfoil.

5. The blade of claim 1, wherein a volume of the at least one internal cavity is less than 20% of the volume of the airfoil.

6. The blade of claim 1, wherein at least one fin of the plurality of fins has a length along a span of the airfoil, a width along a chord-wise direction of the airfoil, and a thickness along the thickness of the airfoil.

7. The blade of claim 6, wherein the length of the at least one fin is in a range from about 30% to about 90% of the span of the airfoil.

8. The blade of claim 6, wherein the width of the at least one fin is in a range from about 30% to about 90% of a chord length of the airfoil.

9. The blade of claim 6, wherein the thickness of the at least one fin is in a range from about 15% to about 30% of the thickness of the airfoil.

10. The blade of claim 6, wherein the at least one fin has varying width, varying thickness, or a combination thereof, along the span of the airfoil.

11. The blade of claim 6, wherein the at least one fin has a corrugated surface.

12. The blade of claim 1, wherein a distance between two adjacent fins in the plurality of fins is less than 30% of the thickness of the airfoil.

13. The blade of claim 1, wherein the at least one internal cavity comprises a separator that extends from an upper end of the at least one internal cavity downwards between the plurality of fins.

14. The blade of claim 13, wherein the plurality of fins are spaced apart from the separator along the thickness of the airfoil.

15. A blade comprising:
an airfoil comprising:
a root portion;
a tip portion;
an internal cavity; and
a plurality of fins integrally coupled to the root portion,
wherein the plurality of fins are disposed along a thickness of the airfoil within the internal cavity,
wherein tips of the plurality of fins are spaced apart from each other along the thickness of the airfoil,
wherein the tips of the plurality of fins are spaced apart from walls of the internal cavity along the thickness of the airfoil, and
wherein the internal cavity has a volume less than 20% of the volume of the airfoil.

16. The blade of claim 15, wherein at least one fin of the plurality of fins has a length along a span of the airfoil, a width along a chord-wise direction of the airfoil, and a thickness along the thickness of the airfoil.

17. The blade of claim 16, wherein the length of the at least one fin is in a range from about 30% to about 90% of the span, the width is in a range from about 30% to about 90% of a chord length of the airfoil, and the thickness is in a range from about 15% to about 30% of the thickness of the airfoil.

18. A turbomachine engine comprising a blade, the blade comprising:
an airfoil comprising:
a root portion;
a tip portion;
at least one internal cavity; and
a plurality of fins disposed in the at least one internal cavity and integrally coupled to the root portion,
wherein the plurality of fins are disposed along a thickness of the airfoil,
wherein tips of the plurality of fins are spaced apart from each other along the thickness of the airfoil, and
wherein the tips of the plurality of fins are spaced apart from walls of the at least one internal cavity along the thickness of the airfoil.

19. The turbomachine engine of claim 18, wherein a volume of the at least one internal cavity is less than 20% of the volume of the airfoil.

20. The turbomachine engine of claim 18, wherein the at least one internal cavity has a length along a span of the airfoil, a width along a chord-wise direction of the airfoil, and a thickness along the thickness of the airfoil.

* * * * *